US005468301A

United States Patent [19]

Monclin

[11] Patent Number: 5,468,301

[45] Date of Patent: Nov. 21, 1995

[54] PROCESS FOR PRODUCING REFINED SUGAR

[75] Inventor: Jean-Pierre Monclin, Wilmar, Minn.

[73] Assignee: International Food Processing Incorporated, Thibodaux, La.

[21] Appl. No.: 285,041

[22] Filed: Aug. 3, 1994

Related U.S. Application Data

[63] Continuation of Ser. No. 224,319, Apr. 7, 1994.

[51] Int. Cl.[6] ..... C13D 1/00; C13D 3/12; C13D 3/16

[52] U.S. Cl. ..... 127/43; 127/42; 127/53; 127/55; 127/56

[58] Field of Search ..... 127/43, 53, 42, 127/55, 56

[56] References Cited

U.S. PATENT DOCUMENTS

| | | | |
|---|---|---|---|
| 2,610,932 | 9/1952 | Eakin | 127/55 |
| 2,953,540 | 4/1952 | Cornwell et al. | 210/8.5 |
| 3,228,876 | 1/1966 | Mahon | 210/22 |
| 3,298,865 | 1/1967 | Rode | 127/41 |
| 3,342,729 | 9/1967 | Strand | 210/23 |
| 3,781,174 | 12/1973 | Nishijima et al. | 127/46.2 |
| 3,914,410 | 10/1975 | Godfrey | 424/131 |
| 4,039,348 | 8/1977 | Hunwick | 127/9 |
| 4,083,732 | 4/1978 | Paley | 127/48 |
| 4,115,147 | 9/1978 | Shimizu et al. | 127/54 |
| 4,156,618 | 5/1979 | Iwami et al. | 127/46 |
| 4,234,350 | 11/1980 | Suzor | 127/48 |
| 4,523,959 | 6/1985 | Exertier | 127/46.2 |
| 4,871,397 | 10/1989 | Stevens | 127/55 |
| 4,950,332 | 8/1990 | Stringfield et al. | 127/55 |
| 5,096,500 | 3/1992 | San Miguel Bento | 127/46.2 |

FOREIGN PATENT DOCUMENTS

| | | | |
|---|---|---|---|
| 0635578A1 | 1/1995 | France | C13F 1/14 |

OTHER PUBLICATIONS

*Application of ultrafiltration and reverse osmosis to can juice,* by R. F. Madsen, M. Sc., Research Dept., A/S De Danske Sukkerfabrikker, Nakskov, Denmark (pp. 163–167).

*Primary Examiner*—Paul Lieberman
*Assistant Examiner*—Patricia L. Hailey
*Attorney, Agent, or Firm*—Pravel, Hewitt, Kimball & Krieger

[57] ABSTRACT

Refined sugar is produced without using conventional refining processes. Clarification of melted raw cane sugar is obtained either by ultra-centrifugation or ultra-filtration, and removal of certain compounds responsible for adverse color quality and viscosity is effected through a set of packed columns filled with an absorbent for these compounds. After evaporation and crystallization, refined cane sugar is produced.

24 Claims, No Drawings

PROCESS FOR PRODUCING REFINED SUGAR

CROSS-REFERENCES TO RELATED APPLICATIONS

This is a continuation-in-part of my prior application, U.S. patent application Ser. No. 08/224,319, filed Apr. 7, 1994, entitled "Process for Producing Refined Sugar Directly from Sugarcane."

FIELD OF THE INVENTION

This invention relates to the purification of raw cane sugar so that refined white sugar can be produced.

BACKGROUND OF THE INVENTION

This invention relates to the satisfaction of the sweet tooth. Specifically, it relates to a radical new way of producing high-quality refined cane sugar from raw cane sugar. However, to fully understand its significance, it is necessary to understand some basic information about what cane sugar is and how it has heretofore been mass-produced.

Cane sugar is a name commonly used to refer to crystalline sucrose, a dissacharide compound used throughout the world in food-processing applications as a sweetener. Crystalline sucrose is primarily produced from the sugarcane plant, a plant which is cultivated in the tropical and semi-tropical regions of the earth.

Throughout the world today, production of refined cane sugar from sugarcane has been accomplished in two steps: (a) the raw sugar process; and (b) the refinery process. In the raw sugar process, sugar mills, located in or near the cane fields, convert the harvested sugarcane plant into a commodity of international commerce known as raw sugar. The raw sugar is transported to sugar refineries, located in population centers throughout the world, where it is converted into its various refined end products. In contrast to the sugar mill, almost the entire output of the sugar refinery is intended, in one form or another, for human consumption.

It should be noted that there have historically been a few classes of unrefined sugar which are intended for human consumption, although they account for but a small proportion of the sugar consumed. One example is whole sugar, a sugar product made by boiling down the cane juice extracted from the sugarcane plant, without the elimination of any impurities. The mixture solidifies upon cooling and is ground resulting in a dark-brown rock-hard sugar product known as jaggery, panela, or muscovado.

Another crude sugar product is plantation white. This product is a bit more visually attractive, but it is only slightly more refined than whole sugar. Basically, plantation white is made directly from the sugarcane plant without going through the raw sugar stage. It is generally a local product of sugar mills, sold at a discounted price, because, although it is perfectly edible, it is not nearly as pure as refined sugar and it cannot be stored for as long.

In the production of raw sugar in the sugar mill, the sugarcane stalks are chopped into small pieces. Then, cane juice is extracted from the sugarcane, leaving behind a fibrous material called bagasse. The extracted juice is then clarified, in part by settling and in part by the addition of heat and lime, which induces precipitation of a floc which, upon removal, enhances the clarification. In many sugar mills, sulfur dioxide is bubbled through the juice, resulting in a bleaching effect which yields a lighter-colored raw sugar.

The clarified juice is then processed through a series of evaporators to eliminate water, which is approximately 85% of the cane juice, resulting in a concentrated sugar solution called syrup. The syrup is then put through a crystallization process, which generates sugar crystals and further separates impurities. Finally, centrifugation separates raw sugar from the syrup, now termed molasses. The molasses is usually processed more than once so that as much of the sugar as possible can be recovered from the syrup.

In the sugar refinery, the raw sugar is cleaned and then melted, producing a refinable liquid termed the sugar liquor (or, simply, the liquor). Then, the liquor is clarified to remove precipitates and other particulate matter. In anticipation of the clarification process, it is commonplace to add substances such as lime which coagulate some of the impurities and form precipitates, as in the raw sugar manufacturing process. Then, the liquor is filtered to remove the precipitates. Typically, the decolorization step which follows is accomplished by carbon adsorbents, such as bone char or activated carbon. In a majority of cases, sulphur dioxide is used to still further improve (bleach) the visual appearance of the resulting sugar. Although carbon adsorbents remain the principal method of decolorization, it should be noted that, because many colorants are of an anionic character, some refineries have chosen to use ion exchange units for color removal. At this point, the liquor is crystal clear with no turbidity. The liquor is passed through evaporators to remove the water and the remaining product is then passed to a vacuum pan for further evaporation and crystallization. A vacuum pan is basically an evaporator which allows for the evaporation of water at a reduced temperature, so that there is less thermal destruction of the sucrose. The end product is then passed through centrifuges to separate the white crystals from the liquor, now termed a syrup.

This basic process, raw sugar manufacturing followed by raw sugar refining, is the process commonly used throughout the world today to produce high-quality white refined cane sugar with a polarization (or, optically measured purity) of from about 99.40% to about 99.99%. It is a two-step process which is employed even in locations where there is a sugar refinery near, or even within, a sugar mill. Even entities outside the sugar industry have arranged their business affairs to accommodate this state of the technology. Raw sugar is traded worldwide as a commodity on the New York and London stock exchanges.

Thus, heretofore, the sugar mills have produced crude sugar products, their main product being raw sugar. The high-quality refined sugars demanded in major population centers, however, have come from another source: the sugar refinery. The sugar refinery is a technologically sophisticated operation that employs expensive equipment and numerous chemicals in order to produce the refined sugar product.

The invention now makes it possible for the sugar refinery to produce high quality refined sugar according to an entirely new and superior method. The inventive process features numerous advantages as disclosed below, among them being the elimination of the need for many of the expensive and hazardous chemicals presently employed in these refineries (e.g. chemicals used to "bleach" the liquor through such processes as clarification with phosphoric acid, decolorization by phosphate-lime treatment or activated carbon). Thus, the invention benefits the U.S. public generally in that it minimizes, at the source, chemicals which are frequent contributors to environmental pollution.

SUMMARY OF THE INVENTION

In the inventive process, particulate matter, colloidal particles, and compounds responsible for viscosity, ash, and color development (e.g., hydroxy methyl-furfurals [hereinafter, "HMF"], dextrans, ketosylamines, and the like) are removed. The contaminants are removed by an ultra-clarification process, intended to remove particulate matter and undissolved solids having a size of from about 0.1 to about 1.0 microns, preferably from about 0.2 to about 0.5 microns, followed by a special adsorption process. The process completely eliminates the need for many of the expensive and hazardous chemicals presently employed in these refineries.

DETAILED DESCRIPTION OF PREFERRED EMBODIMENT

A. Overview of the Raw Sugar Process Disclosed in U.S. patent application Ser. No. 08/224,319 and the Refinery Process Disclosed Herein As disclosed in my prior application, U.S. patent application Ser. No. 08/224,319, hereby fully incorporated by reference, the preferred embodiment of the raw sugar process for producing refined sugar directly from sugarcane includes several steps. Briefly, the cane juice must first be extracted from the sugarcane stalks. This extracted cane juice is then heated and its pH is elevated. An intense clarification process follows to remove particulate matter. The clarified cane juice is then treated by contacting it with an adsorbent resin. The treated cane juice is then separated from the adsorbent resin. Finally, refined sugar is separated from the treated cane juice by crystallization and centrifugation. Each of these steps, and variations thereof, are discussed in detail in my prior application, U.S. patent application Ser. No. 08/224,319.

If the preferred raw sugar process previously disclosed is employed, there will be little need for the use of any kind of refinery process, because the sugar produced is of comparable very high quality. In the event that a conventional raw sugar process is employed, the inventive refinery process herein disclosed should be employed, instead of the conventional refinery processes known today.

The preferred embodiment of the refinery process herein disclosed for producing refined sugar includes several steps. Briefly, the raw sugar received from the sugar mill must first be washed in a step known as affination. The washed sugar is then melted in hot water in order to generate a refinable liquid termed the mother liquor (or, simply, the liquor). An intense clarification process follows to remove particulate matter. The clarified liquor is then treated by contacting it with an adsorbent resin. The treated liquor is then separated from the adsorbent resin. Finally, refined sugar is separated from the treated liquor by crystallization and centrifugation. Each of these steps, and variations thereof, are discussed in more detail below.

B. The Refinery Process

The preferred embodiment of the refinery process herein disclosed for producing refined sugar includes several steps. Briefly, the raw sugar received from the sugar mill must first be washed in a step known as affination. The washed sugar is then melted in hot water in order to generate a refinable liquid termed the sugar liquor (or, simply, the liquor). An intense clarification process follows to remove particulate matter. The clarified liquor is then treated by contacting it with an adsorbent resin. The treated liquor is then separated from the adsorbent resin. Finally, refined sugar is separated from the treated liquor by crystallization and centrifugation. Each of these steps, and variations thereof, are discussed in more detail below.

The first step of the preferred process is the step of affinating (or, washing) the raw sugar received from the sugar mill. This step is performed, because a molasses film frequently forms on the outside of the raw sugar crystals.

The next step is the step of melting the affinated raw sugar in hot water to generate a refinable liquid liquor for subsequent refining. The details of the affination and melting processes are well-known to those of ordinary skill in the art.

The clarification step which follows preferably features either ultra-filtration or ultra-centrifugation. Whether ultra-filtration or ultra-centrifugation is employed, the objective of this step of the process is the removal of particulate matter and undissolved solids having a size of from about 0.1 to about 1.0 microns, preferably from about 0.2 to about 0.5 microns, from the juice. Note: 1 micron=10,000 angstrom=0.00004 inch. At this point, the clarified liquor has the following properties: color of from about 300 to about 4,500 sugar color units, preferably from about 500 to about 1,500 sugar color units; purity of from about 94% to about 99%, preferably from about 7.0% to about 98.0%; a suspended solids content of from about 0.04% to about 0.60%, preferably from about 0.1% to about 0.2%; a brix of from about 40% to about 60%, preferably from about 50% to about 58%; a dextrans concentration of from about 20 to about 80 parts per million (ppm); an ash content of from about 0.1% to about 0.2%; and some turbidity.

The terms ultra-filtration and ultra-centrifugation are frequently used in the art to designate clarification processes which remove particles above a predetermined size on the order of 1 micron or less. That is, for example, in the case of a "1 micron cut" or "1 micron ultra-clarification," particles having an average size of 1 micron or greater are removed. Their removal greatly clarifies the liquor. As stated above, removal of particles as small as 0.1 microns (i.e., a 0.1 micron cut) is possible via ultra-filtration or ultra-clarification. However, a cut approaching 0.1 microns becomes increasingly expensive. For example, in the case of ultra-filtration, the filters clog or foul much more frequently, and they must therefore be cleaned more frequently, resulting in more downtime. Thus, as stated, it is preferred that the cut ranges from about 0.2 to about 0.5 microns, because this range of cuts generates a preferred liquor in an economic fashion.

Ultrafiltration is a pressure-driven membrane process capable of separating solution components on the basis of molecular size and shape. Under an applied pressure differential across the ultra-filtration membrane, solvent and small solute species pass through the membrane and are collected as the permeate; larger solute species are retained by the membrane and recovered as the concentrated retentate.

When the clarification step is effected by ultra-filtration, either mineral or organic membranes may be used. Mineral membranes (e.g., ceramic membranes, zirconia membranes, and alumina-based membranes) are usually chosen, because of the consistency of their pore diameters. These filters usually have a support material of either carbon or stainless steel. When using these filters, it is desirable to maintain a cross-flow velocity across the surface of the membrane of from about 2 to about 6 meters/second, and preferably from about 3 to about 5 meters/second, in order to avoid fouling of the pores of the membrane. Also, in the case of the mineral membrane, the pH of the clarified juice will frequently have to be from about 6.8 to about 8.0 in order to avoid destroying the crystalline structure of the membrane.

Organic membranes (e.g., polyethersulfone materials blended with a hydrophilic cross-linking agent and the like) are sometimes used, because they have a wider pH tolerance, excellent chemical resistance, and good mechanical strength. In order to use these membranes, a temperature of from about 60° C. to about 80° C., preferably from about 74° C. to about 78° C., will be necessary for several reasons, including (1) avoiding bacterial growth; (2) allowing for the use of sodium hydroxide for cleaning of the pores when fouled; and finally (3) enhancing the performance of the filter, so that a sustained flow rate through the filter of from about 0.01 to about 1.0 gallons per minute per square foot of membrane (gpm/ft$^2$), preferably from about 0.1 to about 0.3 gpm/ft$^2$ of membrane, may be maintained.

Whether mineral or organic membranes are employed, good processing efficiencies are obtained when the filtered liquor (or, permeate) represents more than 98% of the feed to the membrane, and the retentate (i.e., the colloidal matter and macromolecules with a size larger than the cut-off of the membrane) represents less than 2% of the feed. For this reason, a screening step may be performed prior to the filtration, in which conventional screening methods are employed to remove particulate matter and undissolved solids having a size of from about 200 to about 1,000 microns, preferably from about 300 to about 500 microns.

When the solvent transports towards the membrane surface, it carries solute which is rejected at the membrane surface, resulting in an accumulation of solute on the membrane. This accumulation can lead to the formation of a gel layer or secondary membrane. The resistance of the gel layer can be greater than that of the membrane, particularly if the gel layer is allowed to become excessively thick and compacted. This occurrence, termed fouling of the membrane pores, is a recurrent problem. Fouling can be reduced, and periods of operation extended, however, by adding at periodic intervals a pulse (or, backwash) step, during which the flow through the filter is briefly reversed opening blocked pores. At less frequent intervals, the membrane is cleaned to remove the particulate matter collected. A substantial increase in the differential pressure between the feed side and the permeate side of a filter to a predetermined level is used to determine when to backwash/clean the filter.

Large scale implementation of this process normally derives efficiency gains from either (a) the parallel operation of several filters, with at least one filter being cleaned or awaiting service, so that continuous filtration is available, and/or (b) multistage, or serial operation, of several filters. Multistage operation is best understood in comparison to batch and single-stage operations. In a batch filtration, the feed solution is pumped continuously from a holding tank, through an ultra-filtration unit, and then back into the holding tank. As solvent is removed, the level in the holding tank falls and solution concentration increases. In the similar single-stage continuous operation (also termed a "feed and bleed" process), a feed stream is pumped from a holding tank into the circuit of a larger circulation stream, in which a large pump is used to pump the stream continuously through the membrane unit. The concentrated product is bled from the circuit at the same rate as the feed stream. A multi-stage continuous filtration operation employs the "bleed" from stage n as the "feed" for stage n+1. Each stage operates at essentially a constant concentration, which increases from the first stage to the last. The concentration of the bleed from the last stage is the final concentration of the multistage process.

In the multi-stage process, the temperature of the ultra-filtration process is usually maintained from about 65° C. to about 80° C., preferably from about 74° C. to about 78° C., in each stage. In the recirculation loop of each stage, the recirculation stream usually operates at from about 100% to about 180% of feed flow, preferably from about 115% to about 143% of the feed flow.

Although the objective of the ultra-clarification step of the process is the removal of particulate matter and undissolved solids having a size of from about 0.1 to about 1.0 microns, preferably from about 0.2 to about 0.5 microns, from the liquor, experiments have indicated that the invention results in an extremely high quality sugar when the ultra-clarification step comprises an ultra-filtration process with a membrane having a pore size as small as 0.01 micron.

Centrifuges remove or concentrate particles of solids in a liquid by causing the particles to migrate through the fluid radially toward or away from the axis of rotation, depending on the density difference between the particles and the liquid. Although the discharge of the liquid may be intermittent, in most commercial centrifuges, the liquid phase discharge is continuous; the heavy solid phase is deposited against the bowl wall for intermittent or continuous removal. Although the specific geometry employed will be dictated, in large part, by economics, tubular-bowl, disk, and nozzle discharge centrifuges are all believed to be effective. In tubular-bowl centrifuges, the bowl is suspended from an upper bearing and drive assembly through a flexible-drive spindle. It hangs freely with only a loose guide in a controlled damping assembly at the bottom. Thus, it can find its natural axis of rotation if it becomes slightly unbalanced because of its process load. Feed enters the bottom of the bowl through a stationary feed nozzle under pressure. The pressure and nozzle size are selected to give a clean jet upward into the bowl at the desired flow rate. The incoming liquid is accelerated to rotor speed, moves upward through the bowl as an annulus, and discharges at the top. Solids travel upward with the liquid and, at the same time, receive a radial velocity based on their size and weight in the centrifugal force field. If the trajectory of a given particle intersects the wall, it is removed from the fluid; if it does not, the particle appears in the effluent.

In disk centrifuges, feed is admitted to the center of the bowl near its floor and it rises through a stack of sheet-metal truncated cones (termed disks) spaced a few millimeters apart. Each disk features holes which form channels through which the liquid rises. Nozzle-discharge centrifuges frequently employ an overall geometry similar to that of the disk centrifuge, except that, in addition, they feature numerous nozzles at the periphery of the bowl. These nozzles effect continuous discharge of the solids.

If the clarification step is effected by ultra-centrifugation, it has been discovered that, in order to achieve the separation (or, cutoff) of particulates with a size larger than 1000 angstroms, it is necessary to obtain a centrifugal force of from about 4,500 to about 12,000 times the force of gravity [hereinafter the G-value], preferably from about 5,000 to about 6,500 G-value. It has also been discovered that, during the centrifugation, oxidation either of the feed or of the discharged product, due to the presence of ambient air, has to be avoided. This is accomplished by means of a hydro-hermetic seal.

A typical design of a continuous centrifuge useful for this process incorporates a conical stack of discs in order to provide a greater surface area on which solids can collect. During the centrifugation process, the temperature is maintained from about 60° C. to about 82° C., preferably from about 74° C. to about 80° C.

As in the case where clarification is effected by filtration, a screening step may be performed prior to the centrifugation, in which conventional screening methods are employed to remove particulate matter and undissolved solids having a size of from about 200 to about 1,000 microns, preferably from about 300 to about 500 microns.

The clarified liquor is then treated by contacting it with an adsorbent resin. The objective of this step of the process is the adsorption/removal of a variety of different macromolecular contaminants, some of which are responsible for adverse color formation and some of which are responsible for a less-than-optimal viscosity in the liquor to be subsequently processed. At this point, the treated/adsorbed liquor has the following properties: color of from about 100 to about 3,500 sugar color units, preferably from about 300 to about 600 sugar color units; purity of from about 94% to about 99%, preferably from about 97.0% to about 98.5%; a suspended solids content of from about 0.01% to about 0.1%, preferably about 0.05%; a brix of from about 25% to about 68%, preferably from about 35% to about 45%; a dextrans concentration of from about 5 to about 20 parts per million (ppm); a kestose/HMF removal percentage of from about 90% to about 95%; an ash content of from about 0.005% to about 0.200%; and no turbidity. Even though the viscosity may range from about 1.0 to about 5.0 centipoise at a temperature of from about 10° C. to about 90° C., preferably the viscosity, at 20° C. and 15 brix, is from about 1.6 to about 2.2 centipoise and more preferably is about 1.8 centipoise.

The adsorbent resin used is made at least in part from a macroporous copolymer of a monovinyl aromatic monomer and a crosslinking monomer, wherein the macroporous copolymer has been post-crosslinked in the swollen state in the presence of a Friedel-Crafts catalyst and functionalized with hydrophilic groups. Adsorbent resins of this type are disclosed in U.S. Pat. No. 4,950,332 to Stringfield et al. [hereinafter the "'332 patent"], herein incorporated in its entirety by reference.

The contact time required to adsorb the contaminants can be expected to vary with several factors, including, e.g., the properties of the resin, the amount of contaminants present, the degree of adsorption desired, the amount of resin employed, and the properties of the sugar solution. Thus, generally speaking, the contact time must be empirically determined.

Although the contacting and the separating of the clarified liquor and the resin may be effected in a batch or semi-batch manner, a common alternative method is the use of packed columns, in which the clarified liquor flows continuously through a packed bed of the resin at such an average velocity that it exits same after an average residence time appropriate for the desired treatment. Although some experimentation will doubtless be required, the inventor's experience indicates that, if this approach is employed, the flow rate should be in the range of about 0.017 to about 0.170 gallons per minute per gallon of resin, preferably in the range of about 0.040 to about 0.060 gpm/gal resin. The pressure drop should be in the range of from about 1 to about 8 pounds per square inch per foot of bed depth for resins of the type disclosed, preferably from about 2 to about 4 psi/foot. The ratio of the height of the resin bed to the column diameter should be in the range of from about 0.5 to about 5.0, preferably in the range of from about 1 to about 4. The resulting retention time is therefore in the range of from about 6 to about 60 minutes, preferably from about 20 to about 30 minutes.

Refined sugar is then separated from the treated liquor by evaporation and crystallization. Evaporation is necessary, because the concentration of sucrose in the treated liquor must reach a certain point before crystals can be generated. To conserve energy, multiple-effect evaporators are commonly employed. Because sugar is heat-sensitive, crystallization is accomplished in vacuum pans, which allow for evaporation and crystal formation at a reduced temperature and pressure. At this point, the evaporated liquor (which, in sugar refineries, is commonly termed a "syrup") has the following properties: color of from about 100 to about 3,500 sugar color units, preferably from about 300 to about 800 sugar color units; purity of from about 94% to about 99%, preferably from about 97% to about 98.5%; a suspended solids content of from about 0.01% to about 0.1%, preferably about 0.05%; a brix of from about 55% to about 70%, preferably from about 65% to about 68%; a kestose/HMF removal percentage of from about 90% to about 95%; and no turbidity.

When the vacuum pan is full, the feed is stopped, and a batch mixture (termed the massecuite) of crystals and syrup is discharged. The massecuite is fed to a centrifuge, so that, by centrifugal force, the sugar crystals may be isolated from the syrup. At this point, the final sugar product has the following properties: color of from about 5 to about 25 sugar color units, preferably from about 10 to about 15 sugar color units; purity of from about 99.6% to about 99.9%, preferably from about 99.8% to about 100%; and an ash content of from about 0.005% to about 0.015%, preferably from about 0.008% to about 0.01%; and no turbidity.

As this disclosure demonstrates, the quality of the liquor in-process and of the refined sugar product is tested by reference to the several physical properties, most of which are calculated according to the procedures recommended by the ICUMSA (International Commission for Uniform Methods of Sugar Analysis). Polarization is a measurement of the optical rotation of a plane of polarized light as it passes through a solution. A saccharimeter is a polarimeter modified for use in the sugar industry; the device directly indicates the sucrose concentration, also termed the direct polarization (abbreviated pol). Suspended solids refers to the percentage by weight of non-dissolved solids in a solution. Density measurements are made using a standard hydrometer, called a spindle, to determine the sugar concentration in syrups, liquors, juices and molasses. These hydrometers are calibrated to yield a pure sucrose concentration (percent sucrose by weight) termed a Brix reading; however, since the density of most components of sugar solutions are not very different, the Brix reading is considered a measure of total dissolved solids. Suspended solids is the percentage by weight of non-dissolved solids. Purity is understood to denote sucrose content as a percentage of total solids, so it is calculated as pol/Brix (and multiplied by 100 to normalize same to a 100% scale).

Although other properties may be tracked for control purposes, if the process of the invention as outlined herein is followed, and ordinary good process controls are maintained, the refined sugar resulting from the process described above will at least have a color less than about 25 sugar color units, an ash content of less than about 0.015%=0.00015, and a polarization of at least about 99.6%.

The following examples are illustrative of the invention and do not limit the scope of the invention as described above and claimed herebelow.

EXAMPLES

Three tests of production of refined sugar were performed following the same procedure. Two samples were produced in a raw cane sugar mill near Veracruz, Mexico; the third sample of raw sugar was produced by a raw cane sugar mill from Louisiana.

The sample of raw cane sugar is melted with sufficient soft and hot water in order to obtain a raw liquor at around 45 brix at 70 degree centigrade. The raw liquor is filtered through a screen with an opening of 150 microns, in order to remove large particulates of foreign matter. Following this, the filtered raw liquor is ultra-centrifuged in a batch ultra-centrifuge developing a force of 8,000 G-value, allowing the separation of all particulate matter larger than 0.01 micron. This step produces two fractions; the first is a clear liquor called polished liquor and the second is essentially a scum. The polished liquor is heated to 85 degree centigrade and passed up-flow thru 2 columns filled with a special adsorbent, Optipore™ from Dow. The two columns are in series, and the flow thru is about 2–3 bed volumes per hour resulting in a retention/contact time of from about 20 to about 30 minutes. Following this, the produced liquor is concentrated in a rotative vacuum batch evaporator to approximately 65 brix, then crystallized in a batch vacuum pan. Seeding is performed with a supersaturation of 1.15 and a vacuum of 22 inches of mercury. When the brix of the mass reaches 92 brix, the crystallization ends and the sugar is separated from the mother liquor with a batch centrifuge, at a speed of 1,500 RPM with a screen opening of 90 microns. A final wash of the sugar is made with soft water at 75 degree centigrade. The crystallized refined sugar is dried and subsequently analyzed.

| | raw sugar #1 from Veracruz | raw sugar #2 from Veracruz | raw sugar #3 from Louisiana |
|---|---|---|---|
| RAW SUGAR | | | |
| color (units) | 3,500 | 1,800 | 1,300 |
| ash (%) | 0.150 | 0.150 | 0.100 |
| POL (%) | 96.8 | 97.2 | 98.5 |
| REFINED SUGAR | | | |
| color (units) | 22 | 18 | 15 |
| ash (%) | 0.012 | 0.008 | 0.009 |
| POL (%) | 99.93 | 99.95 | 99.99 |

What is claimed is:

1. A process for producing refined sugar from raw sugar in the absence of added chemical components comprising the following steps:

(a) melting said raw sugar to produce liquor;

(b) ultra-clarifying the liquor to remove particulate matter and/or undissolved solids of greater than from about 0.1 to 1.0 micron, wherein said ultra-clarifying is performed by a process step selected from the group consisting of ultra-filtration, ultra-centrifugation, and screening;

(c) treating the ultra-clarified liquor by contacting the ultra-clarified liquor with an adsorbent resin, wherein said adsorbent resin is made at least in part from a macroporous copolymer of a monovinyl aromatic monomer and a crosslinking monomer, wherein the macroporous copolymer has been post-crosslinked in the swollen state in the presence of a Friedel-Crafts catalyst and functionalized with hydrophilic groups;

(d) separating the treated liquor from the adsorbent resin; and (e) separating refined sugar from the treated liquor.

2. The process of claim 1 wherein the step of ultra-clarifying the liquor comprises ultra-filtering the liquor with a membrane having a pore size of about 0.01 micron to remove undissolved solids of sizes greater than from about 0.2 to 0.5 micron.

3. The process of claim 1 wherein the step of ultra-clarifying the liquor comprises screening the liquor with a membrane having a size greater than about 1,000 microns and then filtering the screened liquor to remove particulate matter and/or undissolved solids having a size greater than about 1.0 micron.

4. The process of claim 1 wherein the step of ultra-clarifying the liquor comprises ultra-centrifuging the liquor at a centrifugal force of from about 4,500 G to about 12,000 G to remove undissolved solids having a size greater than from about 0.2 to 0.5 micron.

5. The process of claim 1 wherein the step of ultra-clarifying the liquor comprises screening the liquor to remove particulate matter having a size greater than about 1,000 microns and then ultra-centrifuging the screened liquor to remove and undissolved solids having a size greater than about 1.0 micron.

6. The process of claim 5 wherein the step of ultra-centrifuging the screened liquor comprises applying a centrifugal force greater than about 4,500 G.

7. The process of claim 1 wherein the separated treated liquor has a color of from about 100 to about 3,500 sugar color units, as measured by the ICUMSA method.

8. The process of claim 1 wherein the step of ultra-clarifying the extracted cane juice comprises removing particulate matter and/or undissolved solids having a size greater than from about 0.2 to 0.5 micron.

9. A process for purifying a liquor produced in the absence of added chemical components and formed of melted raw sugar, comprising the following steps:

(a) ultra-clarifying the liquor to remove particulate matter greater than from about 0.1 to 1.0 micron, wherein said ultra-clarifying is performed by a process step selected from the group consisting of ultra-filtration, ultra-centrifugation, and screening; and (b) treating the ultra-clarified liquor by contacting the clarified liquor with an adsorbent resin for a predetermined period of time, wherein said adsorbent resin is made at least in part from a macroporous copolymer of a monovinyl aromatic monomer and a crosslinking monomer, wherein the macroporous copolymer has been post-crosslinked in the swollen state in the presence of a Friedel-Crafts catalyst and functionalized with hydrophilic groups.

10. The process of claim 9 wherein the step of ultra-clarifying the liquor comprises filtering the liquor to remove undissolved solids.

11. The process of claim 10 wherein the step of filtering the liquor comprises filtering with a mineral membrane.

12. The process of claim 10 wherein the step of filtering the liquor comprises filtering with an organic membrane.

13. The process of claim 9 wherein the step of ultra-clarifying the liquor comprises screening the liquor to remove particulate matter and/or undissolved solids having a size greater than about 500 microns and then filtering the screened liquor to remove particulate matter and/or undissolved solids having a size greater than from about 0.5 micron.

14. The process of claim 13 wherein the step of filtering the liquor comprises filtering with a mineral membrane.

15. The process of claim 13 wherein the step of filtering the liquor comprises filtering with an organic membrane.

16. The process of claim 9 wherein the step of ultra-clarifying the liquor comprises ultra-centrifuging the liquor to remove particulate matter and/or undissolved solids having a size greater than from about 0.2 to 0.5 micron.

17. The process of claim 16 wherein the step of centrifuging the liquor comprises applying a centrifugal force greater than about 5,000 G.

18. The process of claim 9 wherein the step of ultra-clarifying the liquor comprises screening the liquor to remove particulate matter and/or undissolved solids having a size greater than about 500 microns and then centrifuging the screened liquor to remove particulate matter and/or undissolved solids having a size greater than from about 0.5 micron.

19. The process of claim 18 wherein the step of centrifuging the screened liquor comprises applying a centrifugal force greater than about 5,000 G.

20. The process of claim 9 wherein the separated treated liquor has a color of from about 300 to about 600 sugar color units, as measured by the ICUMSA method.

21. A process for purifying an ultra-clarified liquor formed of melted sugar cane with particulate matter and/or undissolved solids having a size greater than about 0.1 to 1.0 micron removed, wherein said ultra-clarifying is performed by a process step selected from the group consisting of ultra-filtration, ultra-centrifugation, and screening, comprising the step of treating the ultra-clarified liquor produced in the absence of added chemical components and by contacting said adsorbent resin is made at least in part from a macroporous copolymer of a monovinyl aromatic monomer and a crosslinking monomer, wherein the macroporous copolymer has been post-crosslinked in the swollen state in the presence of a Friedel-Crafts catalyst and functionalized with hydrophilic groups and separating the treated liquor from the adsorbent resin.

22. The process of claim 21 wherein the separated treated liquor has a color of from about 100 to about 3,500 sugar color units, as measured by the ICUMSA method.

23. The process of claim 21 wherein the step of ultra-clarifying the extracted cane juice comprises removing particulate matter and/or undissolved solids having a size greater than from about 0.2 to 0.5 micron.

24. A refined sugar product produced by the process of any one of claims 1, 9 or 21.

* * * * *